US006590552B1

(12) United States Patent
Yokoyama et al.

(10) Patent No.: US 6,590,552 B1
(45) Date of Patent: Jul. 8, 2003

(54) METHOD OF DRIVING LIQUID CRYSTAL DISPLAY DEVICE

(75) Inventors: Ryoichi Yokoyama, Ohgaki (JP); Naoaki Komiya, Ohgaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/340,350

(22) Filed: Jun. 25, 1999

(30) Foreign Application Priority Data

Jun. 29, 1998 (JP) ..... 10-182397
Jun. 18, 1999 (JP) ..... 11-172790

(51) Int. Cl.[7] ..... G09G 3/36

(52) U.S. Cl. ..... 345/92; 345/87; 345/89; 345/94; 345/96; 345/99; 345/98; 345/100; 345/211; 345/212; 345/213

(58) Field of Search ..... 345/87, 96, 206, 345/207, 211, 208, 92, 212, 213, 99, 89, 94, 98, 100

(56) References Cited

U.S. PATENT DOCUMENTS 5,515,187 A * 5/1996 Nakamura et al. ..... 349/42
5,867,139 A * 2/1999 Tanaka et al. ..... 345/92
5,923,310 A * 7/1999 Kim ..... 345/90
6,064,363 A * 5/2000 Kwon ..... 345/98
6,124,840 A * 9/2000 Kwon ..... 345/87
6,172,663 B1 * 1/2001 Okada et al. ..... 345/96
6,229,510 B1 * 5/2001 Kim et al. ..... 345/87

* cited by examiner

*Primary Examiner*—Richard Hjerpe
*Assistant Examiner*—Ali Zamani
(74) *Attorney, Agent, or Firm*—Hogan & Hartson, LLP

(57) ABSTRACT

In a liquid crystal display device where a TFT is connected to each pixel electrode, a storage capacitor voltage $V_{SC}$ inverted after a fall of a gate voltage $V_G$ is applied to a storage capacitor line provided for each gate line. A pixel voltage $V_P$ retained in a liquid crystal capacitor is influenced by a rise or a fall of the storage capacitor voltage $V_{SC}$ via the storage capacitor, to then rises or fall. By decreasing the amplitude of a drain voltage $V_D$ and utilizing a direct-current voltage as a common voltage $V_{com}$, the device requires less current and power consumption is reduced.

10 Claims, 4 Drawing Sheets

METHOD OF DRIVING LIQUID CRYSTAL DISPLAY DEVICE

BACKGROUND OF THE INVENTION

1. Field of the Invention

The present invention relates to a method of driving a liquid crystal display device, and more particularly to a driving method hat requires only a low voltage and consumes a reduced amount of power.

2. Description of the Related Art

A liquid crystal display (LCD) is formed by enclosing liquid crystal in the space between two transparent substrates, each having a transparent electrode formed thereon. As liquid crystal is electro-optically anisotropic, it exhibits optical properties in accordance with field strength if a desired voltage is applied across the electrodes to form an electric field in the liquid crystal layer. Utilizing such properties, a displayed image is formed as a collection of pixels, each presenting a desired brightness, by applying different voltages to the respective pixels. LCDs display an image thus formed by voltage control, providing various advantages such as reductions in size, thickness, and power consumption. As a result, LCDs are practically manufactured and widely used in office automation equipment, audio-visual devices, and the like.

FIG. 1 is an equivalent circuit diagram of such an LCD. A gate line 11 and a drain line 12 cross each other. At the intersection thereof, the LCD includes a thin film transistor (TFT) 13 serving as a switching element; a liquid crystal capacitor 14 and a storage capacitor 15, each having one electrode connected to the TFT 13; and a storage capacitor line 16 connected to the second electrode of the storage capacitor 15. The storage capacitor line 16 is shared by all the storage capacitors 15. The other electrode of the liquid crystal capacitor 14 is provided as a common electrode formed on a substrate opposite to the substrate on which the TFT 13 is disposed with liquid crystal interposed therebetween, and is connected to a common line 17.

FIG. 2 illustrates waveforms of signal voltages driving the LCD shown in FIG. 1. During an ON period, a gate voltage $V_G$ applied to the gate line 11 attains a high level. During this period, the TFT 13 is turned on, resulting in drain-source conduction. As a result, a source voltage $V_S$ becomes equal to a drain voltage $V_D$ applied to the drain line 12, and is applied to said one electrode of each of the liquid crystal capacitor 14 and the storage capacitor 15. At the beginning of an OFF period, the gate voltage $V_G$ falls to a low level, turning of f the TFT 13, to thereby determine the source voltage $V_S$.

At the instant the gate voltage $V_G$ falls from the high level to the low level, the source voltage $V_S$ falls by an amount $\Delta V_S$ due to capacitance coupling, and is retained as a pixel voltage $V_P$. Meanwhile, the respective other electrodes of the liquid crystal and storage capacitors 14 and 15 receive the same common voltage $V_{com}$ from the storage capacitor line 16 and the common line 17. The resulting difference in voltage between the common voltage $V_{com}$ and the pixel voltage $V_P$ serves as a voltage $V_{LC}$ for driving liquid crystal that is applied to the liquid crystal and storage capacitors 14 and 15. The pixel voltage $V_P$ is maintained by off-resistance of the TFT 13 until the TFT 13 is turned on again to charge the capacitor to a different voltage in the next field, though it is decreased by an amount $\Delta V_K$ due to leakage current. As the storage capacitor 15 is connected in parallel to the liquid crystal capacitor 14, exactly the same voltage is applied thereto, so that these capacitors 14 and 15 contribute to a reduction in the amounts $\Delta V_S$ and $\Delta V_K$ by increasing their combined capacitance.

Usually, the polarity of the voltage applied to the liquid crystal capacitor 14 is inverted every frame period, field period, line period, or the like, in order to prevent deterioration of the liquid crystal. This method is referred to as a common inversion driving method, in which the polarity of the common voltage $V_{com}$ is inverted at the opposite timing to the drain voltage $V_D$. Consequently this method achieves a decrease in the amplitude of the drain voltage $V_D$ and a reduction in a power supply voltage for a drain driving circuit, contributing to a decrease in power consumption.

However, according to such a common inversion driving method, the common voltage $V_{com}$ is an alternating-current voltage signal, and is applied in common to all the liquid crystal and storage capacitors 14 and 15. As a result, considerable wiring capacitance of the storage capacitor line 16 and of the common line 17 is necessary and a large amount of current flows during the change in voltage. This increases overall power consumption of the device, including the power consumed by the common electrode and the storage capacitor electrode.

SUMMARY OF THE INVENTION

The present invention was conceived to solve the above-described problems, and aims to provide a display device that consumes less electric power than current devices.

In order to achieve the above object, the present invention is directed to a method of driving a liquid crystal display device comprising a pixel electrode formed on a first substrate, a switching element connected to said pixel electrode, a common electrode formed on a second substrate, liquid crystal provided between said pixel electrode and said common electrode, and a storage capacitor utilizing said pixel electrode as one electrode.

This method comprises the step of applying, to the other electrode of said storage capacitor, a storage capacitor voltage that is changed from a low level to a high level immediately after said switch element is turned off during a period in which a voltage of said pixel electrode is higher than that of said common electrode, and that is changed from the high level to the low level after said switching element is turned of f during a period in which the voltage of said pixel electrode is lower than that of said common electrode.

According to one aspect of the present invention, the voltage of said common electrode is a direct-current voltage.

By thus changing the level of the storage capacitor voltage in accordance with a relationship between the voltages of the pixel electrode and the common electrode, the voltage of the pixel electrode can be shifted. As described above, the storage capacitor voltage attains a high level during a period in which the pixel electrode voltage is higher than the common electrode voltage and said switching element is off, and attains a low level during a period in which the pixel electrode voltage is lower than the common electrode voltage and said switching element is off. Consequently, a sufficiently large voltage can be applied to the liquid crystal capacitor even if an amplitude of the voltage of a display signal supplied to each switching element is decreased.

Another aspect of the present invention is directed to a method of driving a liquid crystal display device comprising a pixel electrode formed on a first substrate, a switching element connected to said pixel electrode, a common electrode formed on a second substrate, liquid crystal provided between said pixel electrode and said common electrode, and a storage capacitor utilizing said pixel electrode as its one electrode. The method according to this aspect then comprises the steps of applying a direct-current voltage to said common electrode and applying, to the other electrode of said storage capacitor, a storage capacitor voltage the level of which changes during a period in which said switching element is off.

According to a still further aspect of the present invention, said storage capacitor voltage changes from a low level to a high level during a period in which said switching element is off and the voltage of said pixel electrode is higher than that of said common electrode, and changes from the high level to the low level during a period in which the voltage of said pixel electrode is lower than that of said common electrode.

According to a yet further aspect of the present invention, the storage capacitor voltage changes from the low level to the high level, or from the high level to the low level, immediately after said switching element is turned off.

By thus changing the level of the storage capacitor voltage and using a direct-current voltage as the voltage of the common electrode, no current flows through said common electrode having a large wiring capacitance. Therefore, the above-described driving method allows reduction in power consumed by the liquid crystal display device.

According to a further aspect of the invention, the present invention is directed to a method of driving a liquid crystal display device comprising a pixel electrode formed on a first substrate, a switching element connected to said pixel electrode, a common electrode formed on a second substrate, liquid crystal provided between said pixel electrode and said common electrode, and a storage capacitor utilizing said pixel electrode as its one electrode, said method comprising the step of applying, to the other electrode of said storage capacitor, a storage capacitor voltage the level of which changes during a period in which said switching element is off.

By thus employing a method in which the level of said storage capacitor voltage is changed, a liquid crystal driving voltage applied across said pixel electrode and said common electrode can be increased without changing the voltage of said common electrode with a large wiring capacitance, and without increasing the voltage of a display signal supplied to said pixel electrode via said switching element. In addition, because the level of the storage capacitor voltage is changed during a period in which said switching element is off, it is possible to ensure complete application of the display signal applied to said pixel electrode via said switching element during an ON period.

According to a further aspect of the present invention, in any of the above described methods of driving a liquid crystal display device, the voltage of said common electrode is set lower than a central voltage of the display signal applied to said switching element by a prescribed voltage.

Further, in any of the above methods of driving a liquid crystal display device, a potential difference between said central voltage and said common electrode voltage is a potential difference in accordance with an amount of change in the voltage of said pixel electrode connected to said switching element exhibited when said switching element is turned off.

By thus establishing said common electrode voltage to satisfy the above-described conditions, the amplitude of the voltage applied to the liquid crystal capacitor is more efficiently increased, to thereby further reduce the amount of power consumed by the device.

DESCRIPTION OF THE PREFERRED EMBODIMENT

Figure 1:
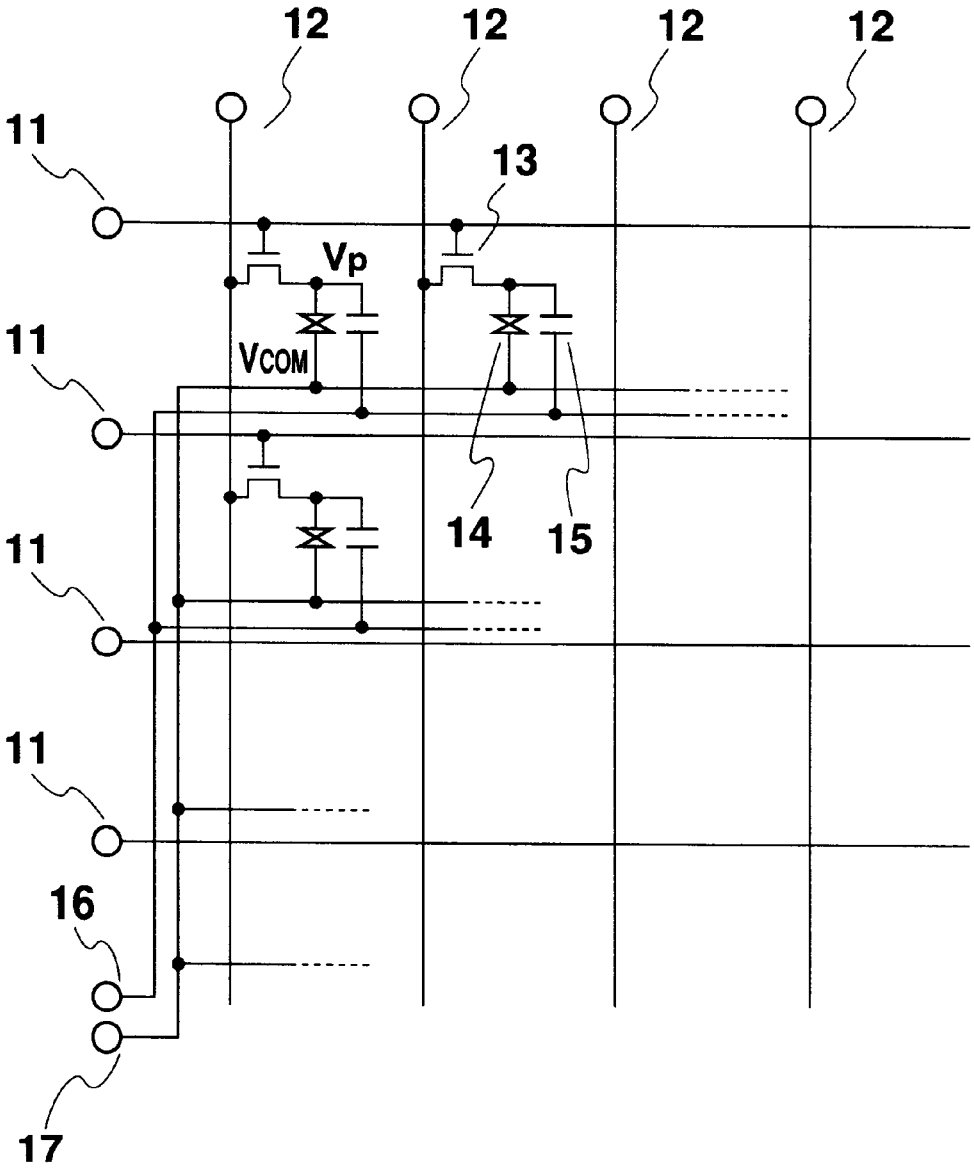
Fig. 1 PRIOR ART
FIG. 1 is an equivalent circuit diagram of a conventional LCD.
Figure 2:
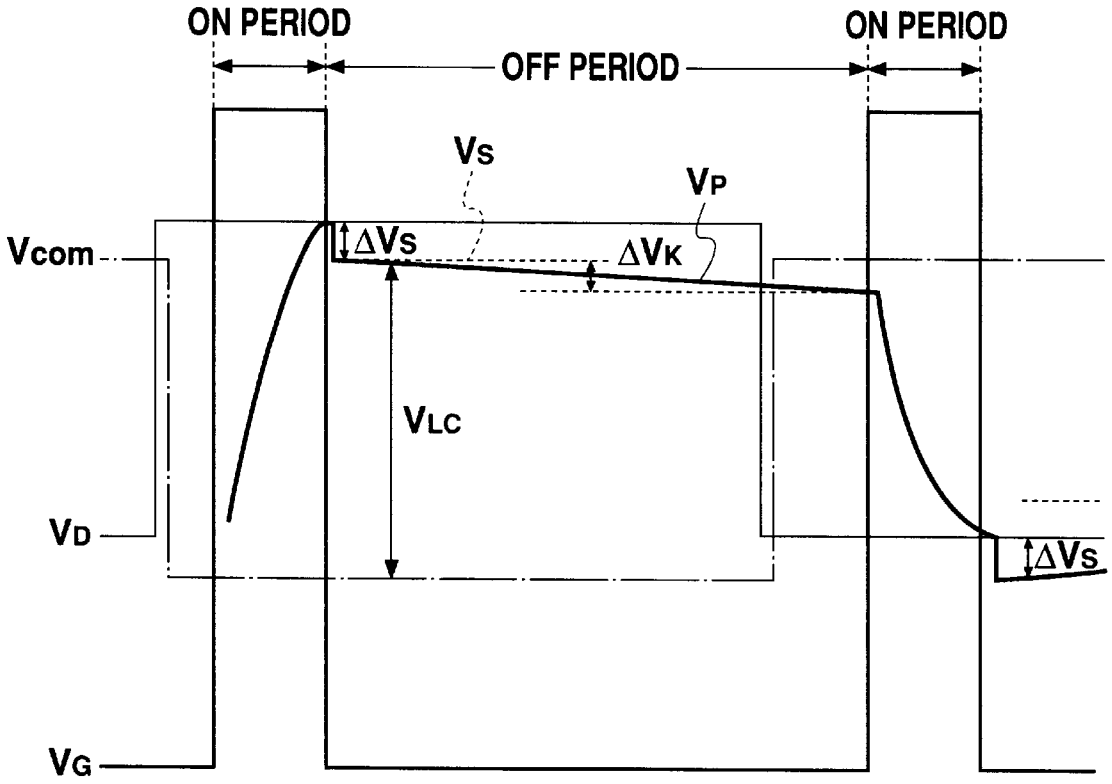
Fig. 2 PRIOR ART
FIG. 2 illustrates signal waveforms used for describing a method of driving the conventional LCD shown in FIG. 1.
Figure 3:
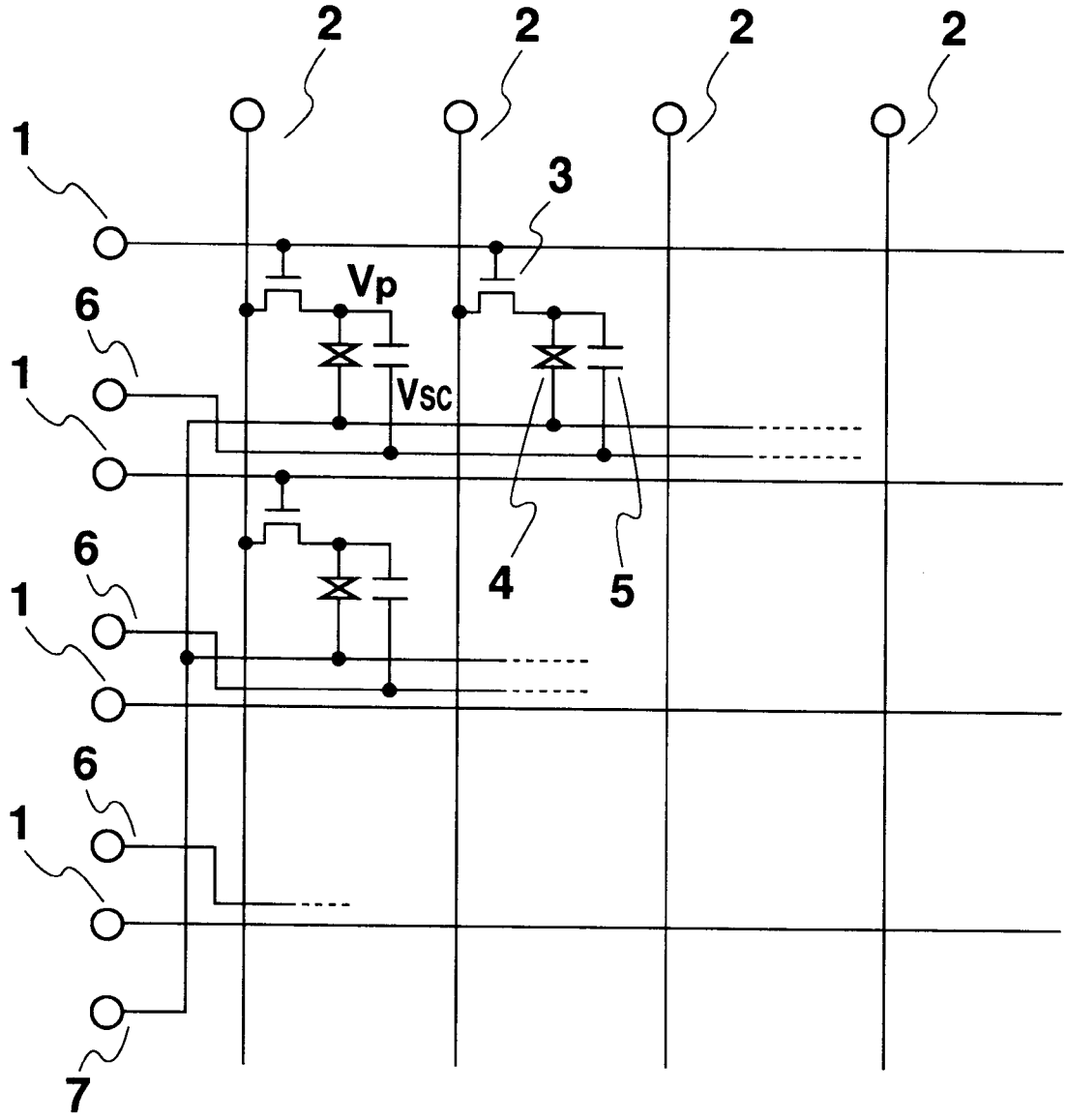
FIG. 3 is an equivalent circuit diagram of an LCD according to an embodiment of the present invention.

FIG. 3 is an equivalent circuit diagram of an LCD according to a first preferred embodiment of the present invention. A gate line 1 and a drain line 2 are provided to cross each other. At an intersection thereof, the LCD includes a TFT 3 serving as a switching element, a liquid crystal capacitor 4 and a storage capacitor 5, each having one electrode connected to the TFT 3, and a storage capacitor line 6 connected to the other electrode of the storage capacitor 5. The storage capacitor line 6 is provided in parallel to the gate line 1, and is shared by the storage capacitors 5 connected to the same gate line 1. The other electrode of the liquid crystal capacitor 4 is provided integrally with a substrate opposite to the substrate on which the TFT 3 is provided with liquid crystal interposed therebetween, and is connected to a common line 7.

Figure 4:
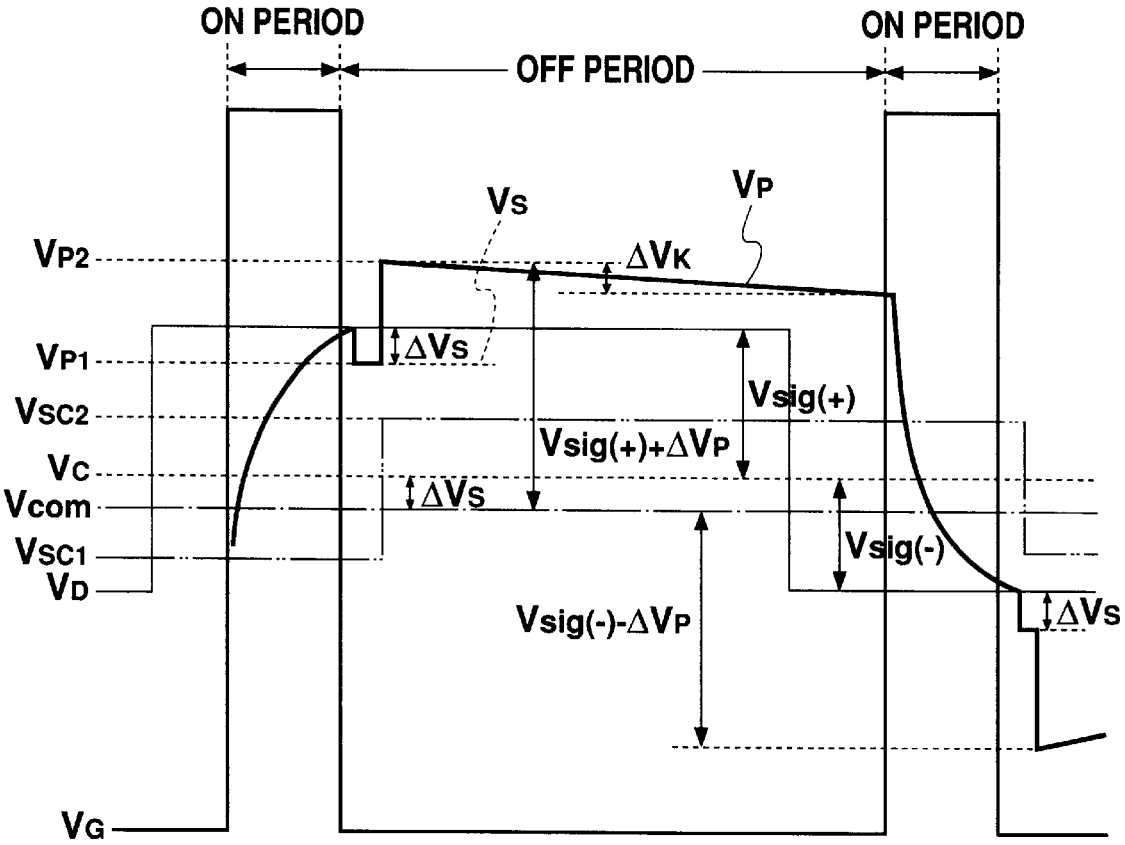
FIG. 4 illustrates signal waveforms used for describing a method of driving the LCD shown in FIG. 3.

FIG. 4 shows waveforms of signals driving the LCD shown in FIG. 3. During an ON period, a gate voltage $V_G$ applied to the gate line 1 attains a high level. During this period, the TFT 3 is turned on, rendering the drain-source region conductive. Consequently, a source voltage $V_S$ follows a drain voltage $V_D$ applied to the drain line 2 to attain the same level, and is applied to one electrode of each of the liquid crystal and storage capacitors 4 and 5. At the beginning of an OFF period, the gate voltage $V_G$ falls to a low level to turn off the TFT 3. As a result, the source voltage $V_S$ is determined, and is dropped by $\Delta V_S$ because of the fall of the gate voltage $V_G$. This source voltage $V_S$ is retained as a pixel voltage $V_P$ during the OFF period. A common voltage $V_{com}$ is a direct-current voltage, set in advance at a level lower than a central level $V_C$ of the drain voltage $V_D$ by the amount $\Delta V_S$ of decrease in the source voltage $V_S$.

A storage capacitor voltage $V_{SC}$ inverted after a fall of the gate voltage $V_G$ applied to the corresponding gate line 1, is applied to each storage capacitor line 6. The storage capacitor voltage $V_{SC}$ attains two levels. For example, during a positive polarity period in which the source voltage $V_S$ exceeds the common voltage $V_{com}$, the storage capacitor voltage $V_{SC}$ rises from a low level $V_{SC1}$ to a high level $V_{SC2}$ after the gate voltage $V_G$ falls. As a result, the pixel voltage $V_P$, obtained when the gate voltage $V_G$ falls and the source voltage $V_S$ is once determined, is influenced by the rise of the storage capacitor voltage $V_{SC}$ via the storage capacitor 5, and thus rises as described below.

Immediately after the gate voltage $V_G$ falls, electric charges $Q_{LC1}$ and $Q_{SC1}$ stored in the liquid crystal capacitor 4 and the storage capacitor 5 attain the values expressed by the following equations:

$$\begin{aligned} Q_{LC1} &= C_{LC}(V_{p1} - V_{com}) \\ &= C_{LC}(V_C + V_{sig} - \Delta V_S - V_{com}) \end{aligned} \tag{1}$$

-continued $$Q_{SC1} = C_{SC}(V_{p1} - V_{SC1}) = C_{SC}(V_C + V_{sig} - \Delta V_S - V_{SC1}) \quad (2)$$

where $V_{sig}$ represents a tone voltage of the drain voltage $V_D$. Thereafter, when the storage capacitor voltage changes from $V_{SC1}$ to $V_{SC2}$, charges $Q_{LC2}$ and $Q_{SC2}$ stored in the liquid crystal capacitor 4 and the storage capacitor 5 can be expressed by the following equations:

$$Q_{LC2} = C_{LC}(V_{p2} - V_{com}) = C_{LC}(V_C + V_{sig} + \Delta V_P - \Delta V_S - V_{com}) \quad (3)$$

$$Q_{SC2} = C_{SC}(V_{p2} - V_{SC2}) = C_{SC}(V_C + V_{sig} + \Delta V_P - \Delta V_S - V_{SC2}) \quad (4)$$

where $\Delta V_P$ represents the amount of change in the pixel voltage $V_P$, i.e. $\Delta V_P = V_{P2} - V_{P1}$. As the total amount of charges retained in the liquid crystal capacitor 4 and the storage capacitor 5 remains unchanged during the OFF period, and therefore the following equation is established.

$$Q_{LC1} + Q_{SC1} = Q_{LC2} + Q_{SC2} \quad (5)$$

Therefore, the following equation is obtained.

$$\Delta V_P = C_{SC}/(C_{SC} + C_{LC}) \times (V_{SC2} - V_{SC1}) \quad (6)$$

More specifically, as the storage capacitor voltage $V_{SC}$ rises, the electric charges are redistributed between the liquid crystal capacitor 4 and the storage capacitor 5, and the pixel voltage $V_P$ rises by the amount $\Delta V_P$ in the equation (6). On the contrary, during a negative polarity period, the storage capacitor voltage $V_{SC}$ falls from a positive value to a negative value, and therefore the pixel voltage $V_P$ falls by the amount $\Delta V_P$ in the equation (6). As a result, the amplitude of the pixel voltage $V_P$ is increased, to thereby raise the voltage applied to the liquid crystal capacitor 4. In other words, the amplitudes of the drain voltage $V_D$ and the common voltage $V_{com}$ can be reduced.

Usually, the capacitance $C_{SC}$ of the storage capacitor is sufficiently greater than the capacitance $C_{LC}$ of the liquid crystal capacitor, and therefore, the value of $C_{SC}/(C_{SC}+C_{LC})$ is close to one. Consequently, as the amount $\Delta V_P$ of change in the pixel voltage is controlled by the change $(V_{SC2}-V_{SC1})$ in the storage capacitor voltage for one line, a greater voltage is applied to the liquid crystal capacitor 4 even with a small amount of current flowing through the storage capacitor line. In other words, the amplitude of the drain voltage $V_D$ can be decreased by changing the storage capacitor voltage, to thereby suppress signal delay on the drain line. The amplitude of the common voltage $V_{com}$ can be reduced by changing the storage capacitor voltage, and no current flows through the common line 7 with a great wiring capacitance by utilizing a direct-current voltage as the common voltage $V_{com}$, to thereby reduce power consumption for each stage.

The change of the storage capacitor voltage (from $V_{SC1}$ to $V_{SC2}$ and from $V_{SC2}$ to $V_{SC1}$) is set to occur during the period in which the TFT, serving as a switching element, is off, and more specifically set to occur immediately after the TFT is turned off. It is also possible to set the change so that the storage capacitor voltage changes at the same time as the TFT is controlled to be turned off, i.e., according to this embodiment, at the fall of the gate voltage $V_G$. However, in the liquid crystal display device practically used, a delay is generated in the waveforms of the driving signals in accordance with time constants related to the material used for wiring in the device, the size of the display device, and the like. For example, it is common for the gate voltage $V_G$ applied to the TFT to not instantly fall as illustrated by the pulse waveform in FIG. 4. In this embodiment, the TFT is not completely turned off unless the gate voltage $V_G$ falls to a sufficiently low value. If the storage capacitor voltage changes under such conditions, the pixel capacitor may not be sufficiently charged in accordance with the drain voltage $V_D$. Therefore, a period from the time when the gate voltage $V_G$ falls to the time when the storage capacitor voltage changes is provided corresponding to the period required for completely turning off the TFT. By providing such a period so that the storage capacitor voltage changes immediately after the TFT is completely turned off, a sufficient display signal voltage in accordance with the drain voltage $V_D$ can be applied to the pixel electrode, and also the pixel voltage $V_P$ can be shifted to a level higher by a prescribed amount during the retaining period (OFF period).

What is claimed is:

1. A method of driving a liquid crystal display device comprising a pixel electrode, a switching element connected to said pixel electrode, and a storage capacitor utilizing said pixel electrode as its one electrode, said pixel electrode, said switching element, and said storage capacitor formed for each pixel on a side of a first substrate, a common electrode formed on a side of a second substrate, and liquid crystal provided between said pixel electrode and said common electrode, said method comprising the step of:

applying, to the other electrode of said storage capacitor formed for each pixel, a storage capacitor voltage that changes from a low level to a high level immediately after said switching element is turned off during a period in which a voltage of said pixel electrode to which said switching element is connected is higher than that of said common electrode, and that changes from the high level to the low level immediately after said switching element is turned off during a period in which the voltage of said pixel electrode is lower than that of said common electrode.

2. The method of driving a liquid crystal display device according to claim 1, wherein the voltage of said common electrode is a direct-current voltage.

3. The method of driving a liquid crystal display device according to claim 2, wherein the voltage of said common electrode is set as being lower by a prescribed voltage than a central voltage of a display signal voltage applied to said switching element.

4. The method of driving a liquid crystal display device according to claim 3, wherein a potential difference between the central voltage and the voltage of said common electrode is a potential difference in accordance with an amount of change in the voltage of said pixel electrode connected to said switching element exhibited when said switching element is turned off.

5. A method of driving a liquid crystal display device comprising a pixel electrode, a switching element connected to said pixel electrode, and a storage capacitor utilizing said pixel electrode as its one electrode, said pixel electrode, said switching element, and said storage capacitor formed for each pixel on a side of a first substrate, a common electrode formed on a side of a second substrate, and liquid crystal provided between said pixel electrode and said common electrode, said method comprising the steps of:

applying a direct-current voltage to said common electrode; and applying, to the other electrode of said storage capacitor formed for each pixel, a storage capacitor voltage, a level of which changes during a period in which said switching element corresponding to said storage capacitor is off.

6. The method of driving a liquid crystal display device according to claim 5, wherein said storage capacitor voltage changes from a low level to a high level during a period in which said switching element is off, and in which the voltage of said pixel electrode is higher than that of said common electrode; and changes from the high level to the low level during a period in which the voltage of said pixel electrode is lower than that of said common electrode.

7. The method of driving a liquid crystal display device according to claim 6, wherein said storage capacitor voltage changes from the low level to the high level, or from the high level to the low level, immediately after said switching element is turned off.

8. The method of driving a liquid crystal display device according to claim 7, wherein the voltage of said common electrode is set lower than a central voltage of a display signal voltage applied to said switching element by a prescribed voltage.

9. The method of driving a liquid crystal display device according to claim 8, wherein a potential difference between the central voltage and the voltage of said common electrode is a potential difference in accordance with an amount of change in the voltage of said pixel electrode connected to said switching element exhibited when said switching element is turned off.

10. A method of driving a liquid crystal display device comprising a pixel electrode, a switching element connected to said pixel electrode, and a storage capacitor utilizing said pixel electrode as its one electrode, said pixel electrode, said switching element, and said storage capacitor formed for each pixel on a side of a first substrate, a common electrode formed on a side of a second substrate, and liquid crystal provided between said pixel electrode and said common electrode, said method comprising the step of:

applying, to the other electrode of said storage capacitor formed for each pixel, a storage capacitor voltage, a level of which changes during a period in which said switching element corresponding to said storage capacitor is off.

* * * * *